US009009924B2

(12) United States Patent
Schnyder

(10) Patent No.: US 9,009,924 B2
(45) Date of Patent: Apr. 21, 2015

(54) CLIP-CLOSURE

(76) Inventor: Viktor Schnyder, Raron (CH)

( * ) Notice: Subject to any disclaimer, the term of this patent is extended or adjusted under 35 U.S.C. 154(b) by 424 days.

(21) Appl. No.: 13/334,088

(22) Filed: Dec. 22, 2011

(65) Prior Publication Data

US 2012/0159741 A1 Jun. 28, 2012

(30) Foreign Application Priority Data

Dec. 24, 2010 (CH) ..... 2173/10

(51) Int. Cl.
*B65D 33/16* (2006.01)

(52) U.S. Cl.
CPC ..... *B65D 33/1616* (2013.01)

(58) Field of Classification Search
CPC ..... A45C 13/30; A45C 13/10; A45C 13/00; B27M 3/34; B65D 33/1675; B65D 33/2591
USPC ..... 24/22, 20 EE, 17 AP, 16 PB, 30.5 L, 24/30.5 R, 339, 115 R, 136 R, 456, 522, 24/591.1, 593.11, 704.1, DIG. 43, DIG. 44
See application file for complete search history.

(56) References Cited

U.S. PATENT DOCUMENTS

| | | | | |
|---|---|---|---|---|
| 4,405,161 | A * | 9/1983 | Young et al. | 285/80 |
| 4,834,730 | A | 5/1989 | Holtermann et al. | |
| 5,546,637 | A | 8/1996 | Niedecker | |
| 5,735,022 | A | 4/1998 | Niedecker | |
| 5,852,850 | A | 12/1998 | Hanten et al. | |
| RE36,544 | E * | 2/2000 | Madsen et al. | 292/307 R |
| 2007/0193313 | A1 | 8/2007 | Tsai | |
| 2009/0267303 | A1 | 10/2009 | Nuppenau et al. | |
| 2009/0276981 | A1 * | 11/2009 | Thompson | 24/115 R |

FOREIGN PATENT DOCUMENTS

| | | | |
|---|---|---|---|
| DE | 1023693 | B | 1/1958 |
| DE | 3544278 | A1 | 4/1987 |
| DE | 4137478 | A1 | 5/1993 |
| DE | 10312567 | B4 | 8/2006 |
| DE | 202006003686 | U1 | 8/2006 |
| DE | 102008020747 | A1 | 10/2009 |
| EP | 0685397 | B1 | 8/1997 |
| EP | 1762494 | A2 | 3/2007 |
| EP | 2112084 | A1 | 10/2009 |

OTHER PUBLICATIONS

European Search Report mailed Apr. 26, 2012 in family-member related EPO application No. EP11195147.

* cited by examiner

*Primary Examiner* — Robert J Sandy
*Assistant Examiner* — Rowland Do
(74) *Attorney, Agent, or Firm* — George Kapsalas; Patentbuero Paul Rosenich AG

(57) ABSTRACT

A clip-closure (1, 2) for closing container systems made from film, includes first closure and second closure part (4,5). A connecting device secures the second closure part (5) to the first closure part (4) in the assembled state. The first closure part (4) may be of U-shaped configuration and includes two limbs (7, 8). The second closure part (5) is of W-shaped configuration and includes a central limb (6) as well as two side limbs (9, 10) spaced apart therefrom. A first part of the connecting device is provided on the limbs (7, 8) of the first closure part (4), and a second part of the connecting device is provided on the side limbs (9, 10) of the second closure part (5). The disclosure also relates to opening tools (41).

20 Claims, 5 Drawing Sheets

CLIP-CLOSURE

CROSS-REFERENCE TO RELATED APPLICATIONS

This application claims benefit of priority of prior Swiss national application no. CH02173/10 filed on Dec. 24, 2010, the entirety of which is expressly incorporated herein by reference in its entirety, for all intents and purposes, as if identically set forth herein.

BACKGROUND

The invention relates to a clip closure for closing bag-shaped or tubular container systems made from film. The invention further relates to an opening tool for opening such a clip closure, as well as a set comprising at least one such clip closure and an opening tool.

Clip closures for closing films and, in particular, endless films are known from the prior art.

DE 4137478A1, for example, discloses a two-part clip closure for closing bag-shaped or tubular container systems made of film, such as for example sausage casings, bags or the like. This clip closure comprises a first closure part and a second closure part corresponding to the first closure part. The first closure part is of U-shaped configuration and comprises two limbs spaced apart from one another, between which a receiver space is formed for a film portion to be closed. The second closure part is of substantially cuboid configuration and comprises a receiver for the free ends of the limbs of the first U-shaped closure part. A connecting device is further provided for non-positively and/or positively securing the second closure part to the first closure part, when said connecting device is in its brought-together state. The connecting device is formed by retaining cams protruding outwardly and provided on the free ends of the limbs of the first U-shaped closure part and engagement recesses configured to correspond to the retaining cams, provided in the receiver of the second closure part. In the brought-together state of the first and second closure parts, the second closure part closes the U-shaped opening of the first closure part and is latched thereto. The film portion gathered up to form a tress is deflected in a wave-shaped manner by a projection under contact pressure.

A significant drawback with this known solution of DE4137478A1 is that said clip closures are, in particular, awkward to handle and may only be used for specific applications.

SUMMARY

The present disclosure provides a clip closure which has clear advantages relative to the prior art with regard to its handlability, its operational and closing reliability as well as its essential usefulness.

In versions of the invention, the second closure part is of W-shaped configuration and comprises a central limb as well as two side limbs spaced apart therefrom on the outside. A first part of the connecting device is further provided on the limbs of the first closure part and a second part of the connecting device corresponding to the first part of the connecting device is provided on the side limbs of the second closure part.

As the clip closure includes two parts, a user is initially able to attach the U-shaped closure part to the film. Advantageously, the receiver space of the first U-shaped closure part is configured so that the entire film portion to be closed may be received and, after inserting the film portion to be closed, the first closure part is maintained on said film portion without the influence of external force. Subsequently, the W-shaped closure part is connected as a mating piece to the first closure part. By the non-positive and/or positive connection of the second closure part to the first closure part, the components do not have to be manually held together, but are mutually fixed. When pressing together and/or when bringing together the first closure part and the second closure part in the longitudinal direction of the limbs, the film portion positioned in the first closure part and to be closed is entrained and pressed together by the central limb of the second closure part, so that a secure closure of the corresponding film portion is provided. The cross-sectional surface of the clip closure is advantageously designed so that a very wide range of types of liner (film systems) may be handled using one type of clip closure.

The entire process for attaching the clip closure may be easily carried out by a user. In principle, the connection and/or engagement of the two closure parts with one another may take place manually.

Subsequently, there exists the option of pressing together the connected and/or pre-fixed clip closure by means of a pressing tool, for example a tong-like apparatus, under pressure for achieving a seal which is as tight as possible.

The second W-shaped closure part additionally ensures a simple opening of a closed clip closure for removing the corresponding film portion from the receiver region of the first U-shaped closure part, by at least one, but advantageously both, side limbs of the second W-shaped closure part being cut off or bent away to the side relative to the first closure part. Advantageously, a tool is used for widening the two limbs of the second W-shaped closure part.

Preferably, the connecting device comprises a latching lock which is easily able to be brought together and ensures sufficient locking of the second connecting part to the first connecting part. Advantageously, the latching lock comprises a plurality of latching teeth arranged adjacent to one another in rows. Additionally, such a latching lock may be easily opened retrospectively by, for example, pivoting away the side limbs of the second connecting part.

Preferably, the first part of the connecting device is provided on the outer faces of the limbs of the first closure part and the second part of the connecting device is provided on the inner faces of the side limbs of the second closure part engaging over the limbs of the first closure part. By "outer face of the limbs of the first closure part" is understood in this connection the face of the limbs which is remote from the receiver space formed by the U-shaped first closure part. By "inner face of the side limbs of the second closure part" is understood the two faces of the side limbs which face one another. If the connecting device comprises a latching lock, by this arrangement of the corresponding elements of the latching lock it is ensured that the film portion to be closed is not able to enter the latching teeth accidentally and is also able to be reopened by removing and/or dismantling the outer second closure part.

It is particularly advantageous that due to the design of the U-shaped and W-shaped closure parts the bringing-together and/or closing of the clip closure may be implemented without the means for non-positive and/or positive connection (for example the latching lock) being located within the pressing zone of the film.

Preferably, indentations adapted to the pressing means may be provided at the top ends for centering a correspondingly configured pressing means, said indentations advantageously being of semi-circular configuration. The two indentations provided in each case at the top end of the closure parts serve, for example, as a mounting and/or engagement surface for a correspondingly configured portion of the pressing tool. By the mutual guidance of both closure parts relative to one another, in this case the pressing force may be uniformly distributed to all elements of the non-positive and/or positive connection between the closure parts.

The closure parts further advantageously comprise rounded outer edges without burrs. By rounding all the outer edges on both closure parts, it is possible in the arrangement of the two closure parts to prevent the film from becoming sharp or damaged.

The U-shaped and/or W-shaped design of the closure parts permits the corresponding film portion to be encased entirely by the closure parts over the entire periphery. Thus the contact pressure of the closure parts and/or the clip closure is distributed over the entire periphery and the entire depth of the film.

Preferably, the first closure part at the end regions of the limbs facing one another comprises in each case an insertion portion which widens the receiver space in this region and thus permits an advantageous insertion of the film portion to be closed which has generally been gathered together.

Alternatively or additionally to the insertion portions on the first closure part, the second closure part at the end regions of the side limbs facing one another comprises in each case an insertion portion whereby the bringing-together of the two closure parts is simplified.

Preferably, the first connecting part is at least partially provided with a structured surface and/or at least the front region of the central limb is provided with a structured surface, whereby on at least part of the contact surfaces between the film portion to be closed and the corresponding closure part and/or the clip closure increased friction is provided therebetween and thus improved fixing is provided of the clip closure on the film portion to be closed.

By means of the structured surface, regions with increased roughness are provided, which is particularly advantageous in clip closures produced from plastics, for example in an injection-moulding/casting method, the adhesion thereof on the film portion to be closed being advantageous. To this end, the corresponding portion of the tool for producing the corresponding connecting part has a negative surface which is configured to correspond to the desired design of the surface region. For example, an erosion structure is provided on the corresponding portion of the tool.

Advantageously, in the first U-shaped connecting part at least the side facing the receiver space of the connecting portion connecting the two limbs is provided with a structured surface. Alternatively or additionally, the inner faces of the limbs of the first connecting part may also be at least partially provided with a structured surface.

If in the second W-shaped closure part a structured surface is provided at least on the front region of the central limb, in this region the friction between the film portion to be closed and the second closure part is increased. Particularly advantageously, in each case both closure parts of the clip closure have a structured surface in the regions which come into contact with the film portion to be closed in the brought-together state of the clip closure.

Advantageously, the front region of the central limb of the second closure part is provided with recesses which further advantageously extend over the entire width of the front region and are advantageously formed as recessed grooves. Film material is forced into the region of these recesses when closing the clip closure, whereby the security of the closure is additionally increased.

One embodiment provides a structural assembly-combination with, in each case, a further clip closure, in the sense of a sub-assembly which is able to be handled in terms of production technology and has the capacity for subsequent separation. Preferably, in particular two clip closures (units) attached to one another are provided. For example, by attaching a sub-assembly consisting of two separate units, two clip closures may be attached at the same time to the corresponding film portion.

In this case, the possibility is preferably provided of cutting off the further clip closure, which has been combined in terms of production technology, by cutting a connecting web connecting the two units, in particular by means of a cutting tool which is also provided for cutting a film to be closed. In particular, the sub-assembly which is attached to the endless film and consists of two separate units may be cut by a cutting process after having being attached to the endless film, whereby an initial clip closure and a final clip closure may be attached to the film and/or to the endless film, substantially by a common operation. The cutting process may result in a common and/or simultaneous cutting of the connecting webs which in each case connect the closure parts, as well as the endless film guided inside the clip closures.

A further embodiment provides that a closure element 62 arranged inside the clip closure and at least partially surrounding the periphery of the film portion to be closed and suitable for induction heating by the at least slightly metallic content, consisting of plastics and/or metal, may be provided for additional heat-based closure of the film portion. The closure element 62 is advantageously arranged inside the pressing zone. By the provision of the closure element 62, an induction field can cause the film portion to melt without contact. After melting and subsequently cooling the corresponding film portion, the closed film portion may be separated between the two separate units (clip closures). The additional melting ensures a closure of the film and/or endless film which is reliably and securely sealed, in particular, against liquid filling material. Moreover, by melting the corresponding film portion a greater containment level may be achieved whereby, in principle, an application using toxic or highly reactive products may also be ensured.

A preferred opening tool for opening a clip closure, the first closure part thereof and the second closure part thereof being brought-together, has a handle for holding the opening tool and a spreading device. The spreading device is of U-shaped configuration and has two limb parts with one free end in each case. The inner faces of the limb parts facing one another laterally define a receiver space for the first closure part and the spacing between an outer face and the corresponding inner face of one limb part reduces in the direction of the free end of the corresponding limb part.

The spacing of the two limb parts relative to one another is advantageously selected so that said limb parts may be easily guided over the outer faces of the limbs of the first closure part, but at the same time not too much play is present between the inner faces of the limb parts and the corresponding outer faces of the limbs of the first closure part. The design of the spreading device is also advantageously adapted to the corresponding dimensions of the clip closure.

The free end of a limb part of the spreading device is advantageously configured so that said free end may penetrate without a large amount of force expenditure between the side limbs of the second closure part and the corresponding limbs of the first closure part.

Said opening tool is simple in construction and able to be easily handled, easy opening of the clip closure being provided. The spreading device of the opening tool is guided over the connecting portion of the first closure part, the free ends of the limb parts when pushing forward the opening tool enclosing the limbs of the first closure part and penetrating between the side limbs of the second closure part and the corresponding limbs of the first closure part. When pushing the opening tool further forward, the side limbs of the second closure part are bent outwards and/or widened. In this case, the latching teeth on the limbs and/or on the side limbs come out of engagement and the closure parts may be separated.

Preferably, the inner faces facing one another of the limb parts extend parallel to one another, whereby guidance is provided over their entire length, along the outer face of the limbs of the first closure part.

Preferably, at least one limb part starting from its free end comprises a guide portion and adjacent thereto a widening portion, whereby easy handling of the opening tool is provided. At the start of the opening process, when the opening tool is positioned, only a slight widening occurs with the corresponding side limb of the second closure part. Only after the limb parts of the spreading device have a certain degree of contact with the corresponding outer faces of the limbs of the first closure part is the corresponding side limb of the second closure part widened by the widening portion, such that the closure parts may be easily separated. Particularly advantageously, both limb parts starting from their free ends comprise in each case a guide portion and adjacent thereto a widening portion, whereby a widening of the side limbs of the second closure part takes place substantially uniformly on both sides. In this case, it is ensured that when using the opening tool for easy separation of the closure parts all teeth present come sufficiently out of engagement. Particularly advantageously, the guide portion and the widening portion are provided in each case on the outer face of a limb part.

Preferably, the free end of each limb portion is rounded which permits simple insertion and/or penetration of the end between the side limbs of the second closure part and the corresponding limbs of the first closure part which advantageously bear against one another fully in the brought-together state.

Preferably, a set is provided for the user which comprises at least one clip closure which has the features cited in this application in connection with the clip closure, and which comprises an opening tool which has the features cited in this application in connection with the opening tool. Advantageously, the set comprises a plurality of clip closures which are able to be used with the corresponding opening tool. Further advantageously, the dimensions of the at least one clip closure and the corresponding dimensions of the opening tool are adapted to one another.

Further advantages, features and details of the invention are revealed from the following description in which an exemplary embodiment of the invention is disclosed with reference to the drawings.

The list of reference numerals forms part of the disclosure. The figures are described in a manner which is cohesive and encompassing. The same reference numerals denote the same components, reference numerals with different indices indicating components which are functionally the same or similar.

DETAILED DESCRIPTION

Figure 1:
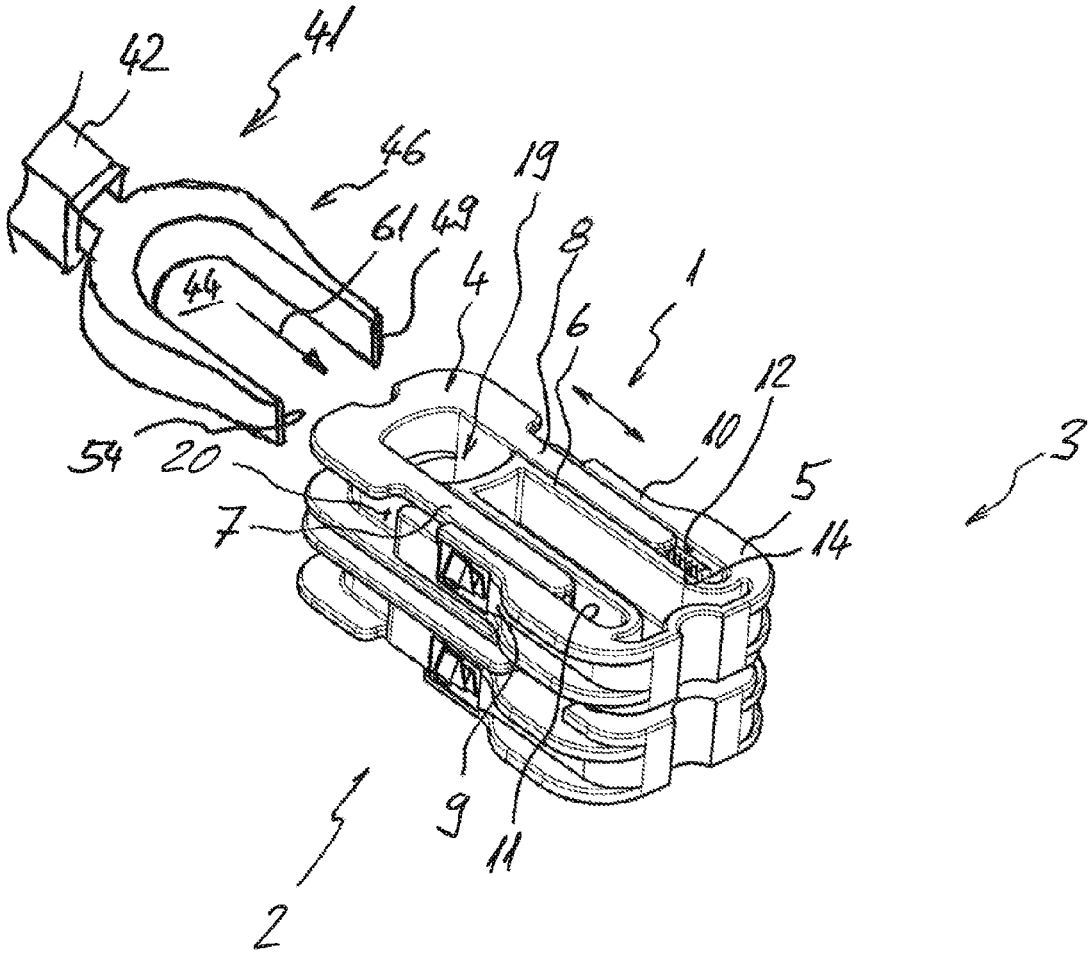
FIG. 1 shows a sub-assembly which has been brought together and consists of two clip closure units.

FIG. 1 shows a sub-assembly 3 formed from two clip closure units 1 and 2. The following description and/or explanation refers to the clip closure 1. The clip closure 2 is configured identically to the clip closure 1.

The clip closure 1 comprises a first U-shaped closure part 4 as well as a second W-shaped closure part 5 corresponding thereto. When pressed together in the longitudinal direction of the limbs (see arrow direction) the central limb 6 of the second closure part 5 is able to be moved into a fixed position between the limbs 7, 8 of the first closure part 4 by entraining the film portion (not shown) to be closed and placed over and/or into the first closure part 1. This fixed position between the limbs 7, 8 of the first closure part 4 and the side limbs 9, 10 of the second closure part 5 engaging thereover on the outside, may be secured non-positively and/or positively.

On the inner faces 11, 12 of the outer side limbs 9, 10, latching teeth 13, 14 located one behind the other are attached into which the latching teeth 17, 18 arranged on the outer faces 15, 16 of the limbs 7, 8 may engage. The individual closure parts 4, 5 may be brought together manually by pressing. The film portion to be closed comes to bear in the receiver space 19 which is provided by bringing together the two closure parts 4, 5 and the film portion is pressed together by pressure from the closure parts 4, 5. In order to increase the pressure on the film portion, the connection of the closure parts 4, 5 may be crimped by means of a pressing tool (crimping process) receiving at least partially the clip closure.

The outer limbs 9, 10 of the second closure part 5 and/or the limbs 7, 8 of the first closure part 4 are provided with guide surfaces 20, 21 corresponding to one another, the guide surfaces 20, 21 ensuring a defined displacement of the closure parts 4, 5 relative to one another. The closure part 4 thus substantially ensures the guidance of the film portion to be closed and the closure part 5 pushes the film with its central limb 6 by pressing into the closure part 4. By bending apart the two outer side limbs 9, 10 the connection may be released and the clip closure thus opened again if required.

Figure 2:
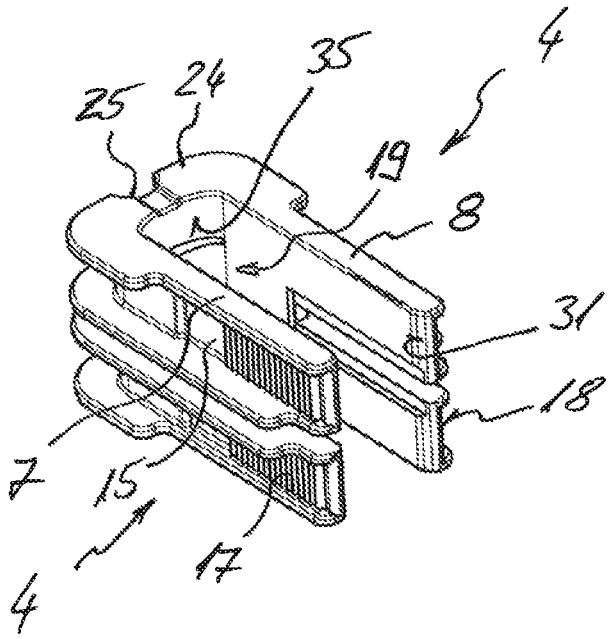
FIG. 2 shows the first closure part in a separate, perspective view.
Figure 3A:
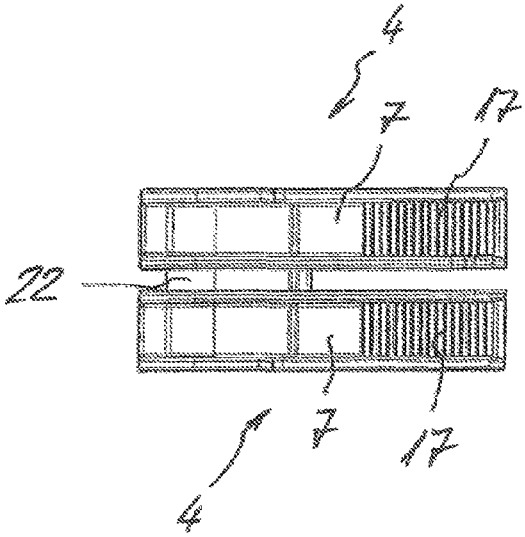
FIGS. 3A-C show the first closure part in a separate view in a side, front and plan view.
Figure 3B:
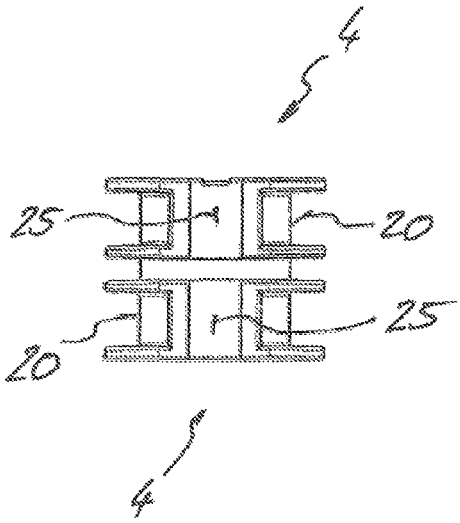
Figure 3C:
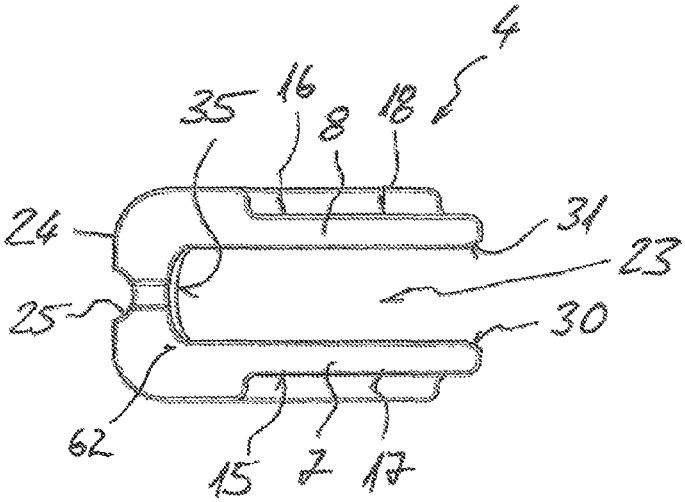

The first closure part 4 is shown in a separate view in FIG. 2 and in a side view (FIG. 3A), in a front view (FIG. 3B) and in a plan view (FIG. 3C). In FIG. 3A, in particular, the connecting web 22 may be seen, said connecting web connecting the two first closure parts 4 together (the same components carry the same reference numerals) and being able to serve as a guide for a cutting or separating tool (not shown here). If the sub-assembly is to be separated, the connecting web 22 may be cut through by means of the cutting tool. The two closure parts 4 are thus configured in one piece and are made in a common operation. The connecting web 22 arranged between the guide surfaces 20 may also be seen clearly in FIG. 3B. In FIG. 3C the receiver space 19 receiving the film may be seen. It may also be easily seen that the first closure part 4 has fully rounded edges without burrs, so that when inserting the film into the receiver space 19 and/or when pushing on the second closure part 5 this does not lead to damage to the film and/or does not eat into the film. At the end regions of the limbs 7, 8 facing one another, the first closure part 4 in each case comprises an insertion portion 30, 31 which in each case are configured as rounded chamfers and widen the opening of the receiver space 19. The side 35 facing the receiver space 19 of the connecting portion 24 of the first connecting part 4 connecting the two limbs 7, 8 is provided with a structured surface. The closure part 4 is designed so that inside the pressing zone 23 and/or inside the receiver space 19 no awkward arrangements (such as for example teeth or the like) which could lead to damaging the film, are attached. An indentation 25 arranged in the connecting portion (top end) 24 of the closure part 4, in this case of semi-circular configuration, serves for the engagement and/or bearing of a pressing tool.

Figure 4:
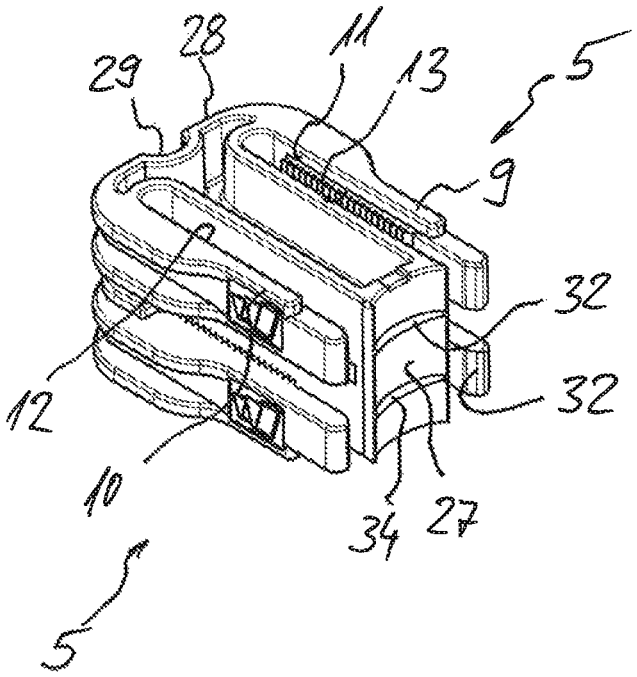
FIG. 4 shows the second closure part in a separate, perspective view.
Figure 5A:
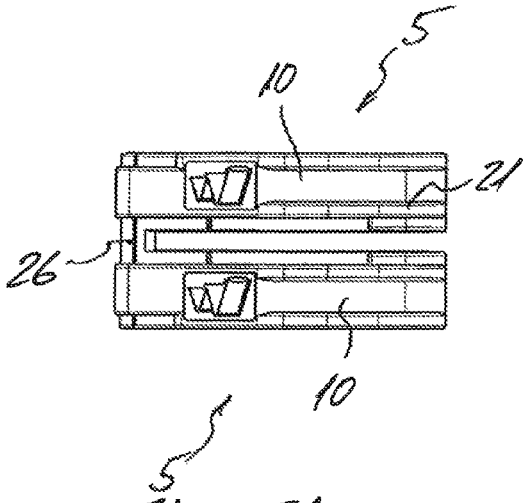
FIGS. 5A-C shows the second closure part in a separate view in a side, front and plan view.
Figure 5B:
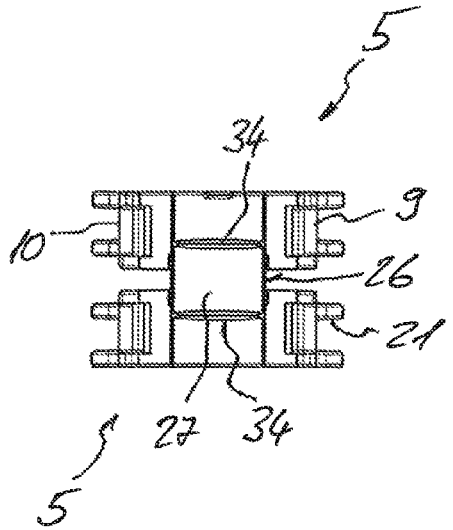
Figure 5C:
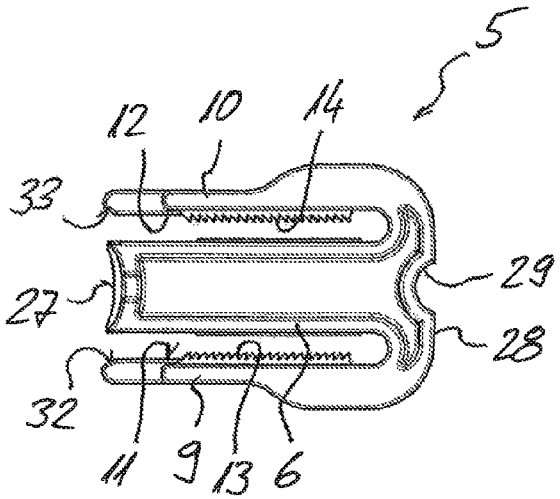

The second closure part 5 is shown in a separate view in FIG. 4 and in a side view (FIG. 5A), in a front view (FIG. 5B) and in a plan view (FIG. 5C). In FIG. 5A in particular the connecting web 26 may be seen, said connecting web connecting the two second closure parts 5 together (the same components carry the same reference numerals) and also being able to serve as guidance for a cutting or separating tool. If the sub-assembly is to be cut, the connecting web 26 may be cut through by means of the cutting tool. The two closure parts 5 are thus configured in one piece and are made in a common operation. The connecting web 26 arranged between the guide surfaces 21 may also be clearly seen in FIG. 5B. The guide surfaces 20, 21 on the connecting parts 4, 5 additionally ensure that, in particular, the central web 26 of the second connecting part 5 is not able to shear off in the event of a tensile load on the film.

In FIG. 5C the two outer side limbs 9, 10 and the central limb 6 may be easily seen. The central limb 6 has a front region 27 of concave configuration. The front region 27 is, on the one hand, provided with a structured surface which is formed by an erosion structure which provides a roughened region coming into contact with a portion of the film portion to be closed, with increased frictional values. Furthermore, on this front region 27 two recessed grooves 34 are provided, spaced apart from one another and extending transversely. These recessed grooves 34 are arranged so that after cutting through the connecting web 26 each second connecting part 5 has a recessed groove 34 in each case. These recessed grooves 34 alone may form the structured surface of the front region 27 of the central limb 6 of the second closure part 5.

Also clearly visible are latching teeth 13, 14 attached to the inner faces 11, 12 of the outer side limbs 9, 10. At the end regions of the side limbs 9, 10 facing one another, the second closure part 5 in each case comprises an insertion portion 30, 31 which in each case are configured as rounded chamfers. An indentation 29 arranged in the curved region 28 (top end) of the closure part 5, and in this case of semi-circular configuration, serves for the engagement and/or bearing of a pressing tool.

Alternatively, for opening the clip closure the two outer side limbs 9, 10 in the curved region 28 of the second closure part 5 may be cut off, damage to the film portion being excluded.

The separation of the two first closure parts 4 and the two second closure parts 5 may take place, for example, before or after mounting and/or before or after inserting the endless film. If the connection is separated subsequently, cutting through the connecting webs 22, 26 results in cutting through the incorporated film portion at the same time. The cutting may be implemented by a single cutting or separating tool.

Hereinafter the advantages of the proposed clip closure may be summarized as follows:

The closure of the corresponding film portion is able to be carried out by one person. The two closure parts 4 and 5 may be attached easily to the corresponding film portion and manually latched together.

Relative to safety, the corresponding film portion is not able to become caught in the closure mechanism. A complete encasing of the corresponding film portion in the pressing zone of the clip closure is ensured. Damage to the corresponding film portion when closing the clip closure and when opening the clip closure is substantially excluded. The combined closure parts of the clip closure may be easily separated from one another subsequently, for example bending up and/or widening the outer side limbs of the second W-shaped closure part.

Clip closures according to the invention are suitable, with variable pressing zone for closing a large number of different bag-shaped or tubular container systems as well as being able to be used for all film materials.

Figure 6:
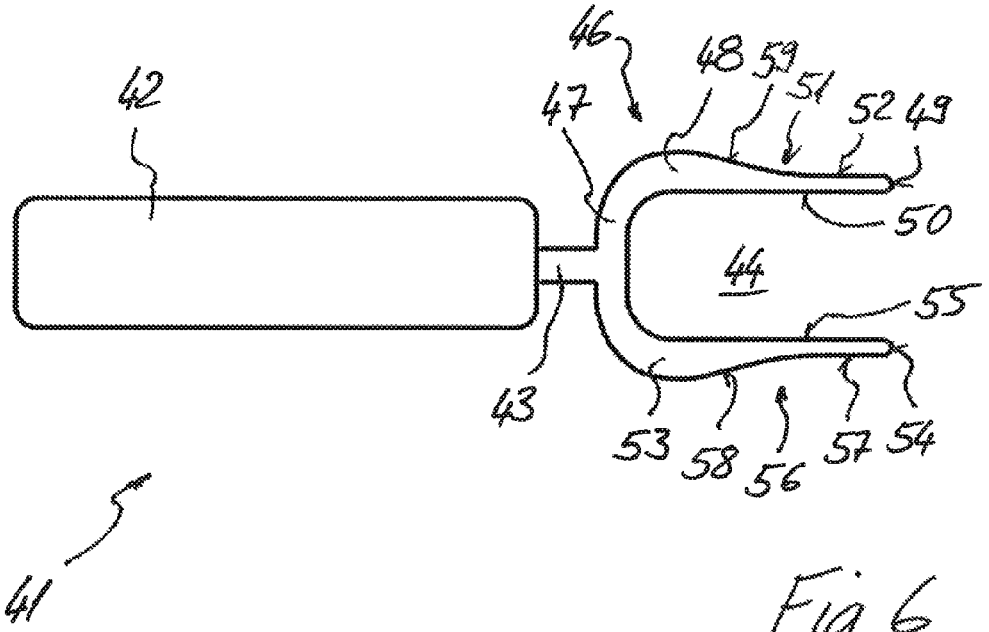
FIG. 6 shows an opening tool for retrospectively opening a sub-assembly which has been brought together, according to FIG. 1 in a schematic view.

The opening tool 41 shown in FIG. 6 for opening a clip closure 1 and/or 2, comprises a handle 42 for holding the opening tool 41 and a spreading device 46. The spreading device 46 is of U-shaped configuration and has two limb parts 48 and 53 with in each case a free end 49 and/or 54 as well as connecting portion 47 arranged on the end of the spreading device 46 facing the handle 42 and connecting said two limb parts 48 and 53. Via a connecting web 43, the spreading device 46 is connected to the handle 42, said connecting web 43 and the spreading device 46 being, for example, configured in one piece. The spreading device 46 and the connecting web 43 are, for example, made from a steel, advantageously a corrosion-resistant steel and/or a material fulfilling further requirements, according to use. For the handle 42 advantageously wood and/or a plastics material is used, which has the appropriate material properties corresponding to the desired or specified standards.

The inner faces 50 and 55 facing one another of the limb parts 48 and 53 laterally define a receiver space 44 for the first closure part 4 and extend parallel to one another. The spacing between an outer face 51 and/or 56 and the corresponding inner face 50 and/or 55 of a limb part 48 and/or 53 reduces in the direction of the free end 49 and/or 54 of the corresponding limb part 48 and/or 53. In other words, each limb part 48 and 53 tapers in the direction of its free end 49 and/or 54.

The free end 49 and/or 54 of each limb part 48 and/or 53 is rounded. The limb parts 48 and 53 have at their outer faces 51 and/or 56 in each case starting from the free end 49 and/or 54 a guide portion 52 and/or 57 and adjacent thereto a widening portion 59 and/or 58.

As visible from FIG. 1, for opening a clip closure 1 and/or 2 the opening tool 41 is guided over the first closure part 4 in the direction of the arrow 61. In this case, the first closure part 4 comes to rest in the receiver space 44 at least partially and when pushing the opening tool 41 further in the direction of the arrow 61 the free ends 49 and 54 penetrate between the limbs 7 of the first closure part 4 and the side limbs 9 of the second closure part 5 and/or between the limbs 8 of the first closure part 4 and the side limbs 10 of the second closure part 5. In this case, the side limbs 9 and 10 are widened and/or respectively bent outward relative to the first closure part 4. The latching teeth 17 and 18 on the first closure part 4 and the latching teeth 13 and 14 on the second closure part 5 come out of engagement and the closure parts 4 and 5 are easily able to be separated from one another.

| List of reference numerals | |
|---|---|
| 1 | Clip-closure |
| 2 | Clip-closure |
| 3 | Sub-assembly |
| 4 | First closure part |
| 5 | Second closure part |
| 6 | Central limb of 5 |
| 7 | Limb of 4 |
| 8 | Limb of 4 |
| 9 | Side limb of 5 |
| 10 | Side limb of 5 |
| 11 | Inner face of 9 |
| 12 | Inner face of 10 |
| 13 | Latching teeth on 11 |
| 14 | Latching teeth on 12 |
| 15 | Outer face of 7 |
| 16 | Outer face of 8 |
| 17 | Latching teeth of 7 |
| 18 | Latching teeth of 8 |
| 19 | Receiver space of 4 |
| 20 | Guide surface of 4 |
| 21 | Guide surface of 5 |
| 22 | Connecting web of 1 |
| 23 | Pressing zone of 4 |
| 24 | Connecting portion of 4 |
| 25 | Indentation of 4 |
| 26 | Connecting web of 2 |
| 27 | Front region of 5 |
| 28 | Curved region of 5 |
| 29 | Indentation of 5 |
| 30 | Insertion portion of 7 |
| 31 | Insertion portion of 8 |
| 32 | Insertion portion of 9 |
| 33 | Insertion portion of 10 |
| 34 | Recessed groove at 27 |
| 35 | Side of 24 |
| 41 | Opening tool |
| 42 | Handle |
| 43 | Connecting web |
| 44 | Receiver space for 4 |
| 46 | Spreading device |
| 47 | Connecting portion |
| 48 | Limb part of 46 |
| 49 | Free end of 48 |
| 50 | Inner face of 48 |
| 51 | Outer face of 48 |
| 52 | Guide portion of 48 |
| 53 | Limb part of 46 |
| 54 | Free end of 53 |
| 55 | Inner face of 53 |
| 56 | Outer face of 53 |
| 57 | Guide portion of 53 |
| 58 | Widening portion of 53 |
| 59 | Widening portion of 48 |
| 61 | Arrow |
| 62 | Inductively heatable portion |

What is claimed is:

1. A clip closure assembly comprising:

a first closure part, said first closure part having a U-shaped configuration, said U-shaped configuration including a first limb, said U-shaped configuration including a second limb, said U-shaped configuration including a connecting portion between said first and second limbs;

a receiver space between said first and second limbs of said first closure part, said receiver space being bounded by said connecting portion and by said first and second limbs;

a second closure part, said second closure part having a unitary W-shaped configuration, said W-shaped configuration including a central limb, said W-shaped configuration including a first side limb, said W-shaped configuration including a second side limb;

said first and second side limbs and said central limb extending longitudinally to respective distal ends, said distal ends being distal from at least one base portion of said W-shaped configuration that joins said first side limb to said central limb and that joins said second side limb to said central limb;

said second closure part configured to receive said first limb of said first closure part U-shaped configuration between said central limb and said first side limb of said W-shaped configuration, said second closure part configured to receive said second limb of said first closure part U-shaped configuration between said central limb and said second side limb of said W-shaped configuration;

said central limb of said unitary W-shaped configuration having a first side wall configured to contact said first limb of said U-shaped configuration, said central limb of said W-shaped configuration having a second side wall configured to contact said second limb of said U-shaped configuration, and said central limb having a front region situated across at least a part of its respective distal end, said front region defining a first wall portion of said receiver space that is at least partially spaced from and opposite to said connecting portion.

2. A clip closure assembly as claimed in claim 1, further comprising:

a latching lock between said first limb of said U-shaped configuration and said first side limb of said W-shaped configuration.

3. A clip closure assembly as claimed in claim 2, further comprising:

said latching lock includes a first interengaging surface part, said first interengaging surface part located on an outer face of said first limb of said U-shaped configuration; and, said latching lock includes a second interengaging surface part, said second interengaging surface part located on an inner face of said first side limb of said W-shaped configuration.

4. A clip closure assembly as claimed in claim 1, further comprising:

respective pressing indentations on said first closure part and on said second closure part, respectively.

5. A clip closure assembly as claimed in claim 1, further comprising:

said first wall portion has a structured surface; and, said receiver space has a second wall portion connected to said connecting portion, said second wall portion having a structured surface.

6. A clip closure assembly as claimed in claim 1, further comprising:

said first and second limbs and said first and second side limbs each have a respective end region, each of said respective end regions including a respective insertion portion.

7. A clip closure assembly as claimed in claim 1, further comprising:

an inductively-heatable portion configured to heat film held in said receiver space.

8. A clip closure assembly as claimed in claim 1, further comprising:

an opening tool handle; and, an opening tool spreading device having a U-shaped configuration, said spreading device connected to said handle, said U-shaped configuration having two limb parts, said limb parts defining a receiver space for said first closure part.

9. A clip closure assembly as claimed in claim 8, further comprising:

said limb parts each having a respective inner face, said respective inner faces extending parallel to one another;

at least one of said limb parts having a respective guide portion, said respective guide portion extending from a free end of said respective at least one limb part, and a widening portion extending from said guide portion; and, said free end being rounded.

10. A clip closure assembly comprising:

a first closure part, said first closure part having a U-shaped configuration, said U-shaped configuration including a first limb, said U-shaped configuration including a second limb, said U-shaped configuration including a connecting portion between said first and second limbs;

a receiver space between said first and second limbs of said first closure part, said receiver space being bounded by said connecting portion and by said first and second limbs;

a second closure part, said second closure part having a unitary W-shaped configuration, said W-shaped configuration including a central limb, said W-shaped configuration including a first side limb, said W-shaped configuration including a second side limb;

said first and second side limbs and said central limb extending longitudinally to respective distal ends, said distal ends being distal from at least one base portion of said W-shaped configuration that joins said first side limb to said central limb and that joins said second side limb to said central limb;

said second closure part configured to receive said first limb of said first closure part U-shaped configuration between said central limb and said first side limb of said W-shaped configuration, said second closure part configured to receive said second limb of said first closure part U-shaped configuration between said central limb and said second side limb of said W-shaped configuration;

said central limb having a front region situated across at least a part of its respective distal end, said front region defining a first wall portion of said receiver space that is at least partially spaced from and opposite to said connecting portion;

a first interengaging surface part located on an outer face of said first limb of said U-shaped configuration;

a second interengaging surface part located on an inner face of said first side limb of said W-shaped configuration;

a third interengaging surface part located on an outer face of said second limb of said U-shaped configuration; and, a fourth interengaging surface part located on an inner face of said second side limb of said W-shaped configuration.

11. A clip closure assembly as claimed in claim 10, further comprising:

respective pressing indentations on said first closure part and on said second closure part, respectively.

12. A clip closure assembly as claimed in claim 10, further comprising:

said first wall portion has a structured surface; and, said receiver space has a second wall portion connected to said connecting portion, said second wall portion having a structured surface.

13. A clip closure assembly as claimed in claim 10, further comprising:

said first and second limbs and said first and second side limbs each have a respective end region, each of said respective end regions including a respective insertion portion.

14. A clip closure assembly as claimed in claim 10, further comprising:

an inductively-heatable portion configured to heat film held in said receiver space.

15. A clip closure assembly as claimed in claim 10, further comprising:

an opening tool handle; and, an opening tool spreading device having a U-shaped configuration, said spreading device connected to said handle, said U-shaped configuration having two limb parts, said limb parts defining a receiver space for said first closure part.

16. A clip closure assembly as claimed in claim 15, further comprising:

said limb parts each having a respective inner face, said respective inner faces extending parallel to one another;

at least one of said limb parts having a respective guide portion, said respective guide portion extending from a free end of said respective at least one limb part, and a widening portion extending from said guide portion; and, said free end being rounded.

17. A clip closure assembly comprising:

a first closure part, said first closure part having a U-shaped configuration, said U-shaped configuration including a first limb, said U-shaped configuration including a second limb;

a receiver space between said first and second limbs of said first closure part;

a second closure part, said second closure part having a W-shaped configuration, said W-shaped configuration including a central limb, said W-shaped configuration including a first side limb, said W-shaped configuration including a second side limb;

said second closure part configured to receive said first limb of said first closure part U-shaped configuration between said central limb and said first side limb of said W-shaped configuration, said second closure part configured to receive said second limb of said first closure part U-shaped configuration between said central limb and said second side limb of said W-shaped configuration;

said central limb of said W-shaped configuration having a front region configured to define a wall portion of said receiver space;

a first interengaging surface part located on an outer face of said first limb of said U-shaped configuration;

a second interengaging surface part located on an inner face of said first side limb of said W-shaped configuration;

a third interengaging surface part located on an outer face of said second limb of said U-shaped configuration;

a fourth interengaging surface part located on an inner face of said second side limb of said W-shaped configuration;

a third closure part, said third closure part having a U-shaped configuration similar to that of said first closure part;

said third closure part being connected to said first closure part by a first web;

a fourth closure part, said fourth closure part having a W-shaped configuration similar to that of said second closure part; and, said fourth closure part being connected to said second closure part by a second web.

18. The clip closure assembly as claimed in claim 17, wherein:

said first and second webs are severable by cutting.

19. A clip closure assembly as claimed in claim 17, further comprising:

said central limb of said second closure part W-shaped configuration having a first side wall configured to contact said first limb of said first closure part U-shaped configuration, said central limb of said second closure part W-shaped configuration having a second side wall configured to contact said second limb of said first closure part U-shaped configuration, and said central limb of said second closure part W-shaped configuration having a front region configured to define a wall portion of said first closure part receiver space.

20. A clip closure assembly as claimed in claim 19, further comprising:

an opening tool handle; and, an opening tool spreading device having a U-shaped configuration, said spreading device connected to said handle, said U-shaped configuration having two limb parts, said limb parts defining a receiver space for said first closure part.

* * * * *